US007150224B2

(12) United States Patent
John

(10) Patent No.: US 7,150,224 B2
(45) Date of Patent: Dec. 19, 2006

(54) RUBBER BLANKET PLATE FOR CLAMPING ONTO A CYLINDER

(75) Inventor: Thomas John, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/010,254

(22) Filed: Dec. 10, 2004

(65) Prior Publication Data

US 2005/0132911 A1 Jun. 23, 2005

(30) Foreign Application Priority Data

Dec. 19, 2003 (DE) ..... 103 60 012

(51) Int. Cl.
*B41F 7/02* (2006.01)

(52) U.S. Cl. ..... 101/217; 101/375

(58) Field of Classification Search ..... 101/217, 101/216, 368, 379, 378, 376, 375, 382, 369, 101/384, 383, 415.1
See application file for complete search history.

(56) References Cited

U.S. PATENT DOCUMENTS

| | | | | |
|---|---|---|---|---|
| 5,327,831 | A * | 7/1994 | Depa et al. | 101/401.1 |
| 5,692,443 | A * | 12/1997 | Reutter | 101/415.1 |
| 5,704,289 | A * | 1/1998 | Bolza-Schunemann et al. | 101/415.1 |
| 6,675,708 | B1 * | 1/2004 | Schneider et al. | 101/415.1 |
| 6,823,788 | B1 * | 11/2004 | Malkic | 101/378 |

* cited by examiner

*Primary Examiner*—Anthony H. Nguyen
(74) *Attorney, Agent, or Firm*—Leydig, Voit & Mayer, Ltd.

(57) ABSTRACT

The rubber-blanket plate comprising a carrier plate (2) on which functional layers (3) are arranged. The functional layers (3) include a covering layer (4), a woven-fabric layer (5) and a compressible layer (6). At the two ends of the rubber-blanket plate (FIG. 4*a*), only the ends of the covering layer (13) extend to the carrier plate (2), whereas the functional layers end before that. As a result, effective protection of the functional layers (3) is attained, and it is possible to use a relatively narrow channel (FIG. 4*a*) in the printing press cylinder upon which the rubber-blanket plate is mounted. Alternatively, all of the functional layers can extend to the end of the carrier plate.

16 Claims, 4 Drawing Sheets

RUBBER BLANKET PLATE FOR CLAMPING ONTO A CYLINDER

FIELD OF THE INVENTION

The present invention relates generally to rubber-blanket plates for use in printing machines, and more particularly, to a composite rubber-blanket plate adapted for clamping about a cylinder of a rotary offset printing press.

BACKGROUND OF THE INVENTION

Rubber-blanket plates of the foregoing type are clamped onto rubber-covered blanket cylinders or transfer cylinders of rotary offset printing presses instead of conventional rubber blankets. As is known in the art, axial channels in the cylinder receive the ends of conventional rubber blankets or rubber-blanket plates which are clamped into fixed position. A disadvantage of known rubber-blanket plates is that edges of functional layers on the carrier plate (which typically is made of steel) are exposed to high mechanical loads and printing chemicals during high speed printing operations. This also occurs during washing of the blanket plates with conventional cleaning units. As a result, the individual functional layers of the blanket plate can become damaged or loosened from the carrier plate. Although it is known to seal the edges of the functional layers to the carrier plate, adhesion of the functional layers often is inadequate, or extensive stretching of the functional layers can result in the risk of stress cracks in the seal.

OBJECTS AND SUMMARY OF THE INVENTION

It is an object of the present invention to provide a rubber-blanket plate for blanket and transfer cylinders of a printing press that is less susceptible to chemical and mechanical breakdown during high speed operation of the printing press.

The invention is carried out by a rubber-blanket plate in which at least a cover layer of the functional layers extends to a leading edge or end of the carrier plate for protectively covering and containing intermediate functional layers. Alternatively, each of the functional layers of the rubber-blanket printing plate can extend to one or both ends of the carrier plate.

Other objects and advantages of the invention will become apparent upon reading the following detailed description and upon reference to the drawings, in which:

Figure 1:
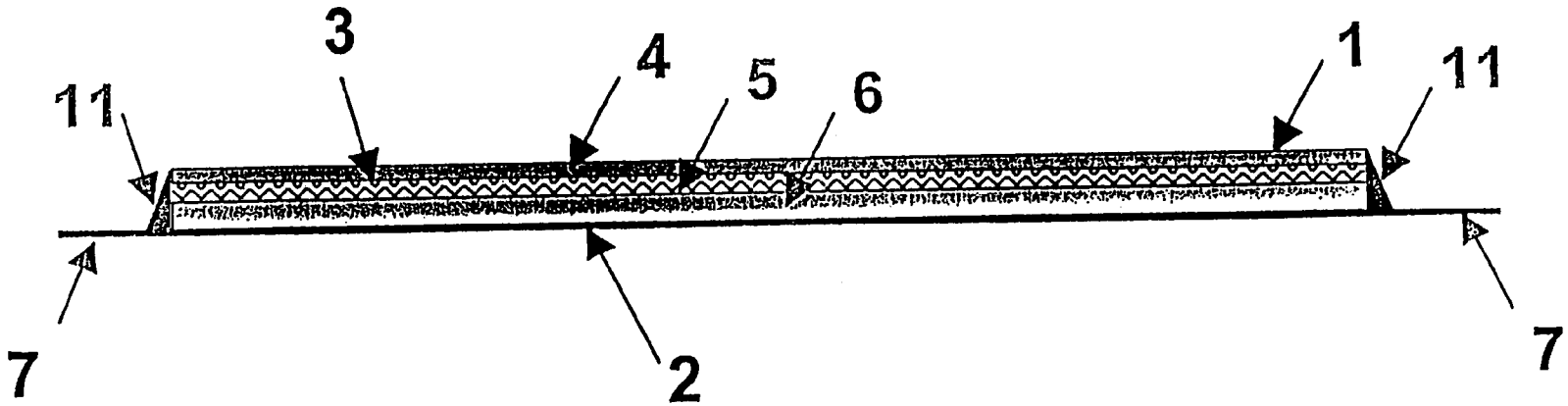
PRIOR ART Fig. 1
FIG. 1 is a longitudinal section of a rubber-blanket plate according to the prior art.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to FIG. 1 of the drawings, there is shown a rubber-blanket plate (1) typical of the prior art, which comprises a tensionally rigid carrier plate (2) which can, for example, be made of a plastic material such as carbon-fiber-reinforced plastic or a steel sheet. The thickness of the plastic or steel sheet typically is 0.200 mm. A plurality of layers (3), commonly referred to as functional layers, are applied to and disposed on the carrier plate (2). The number and sequence of the functional layers on the carrier plate usually is different from manufacture to manufacture and also partly depends upon the intended usage of the rubber-blanket plate. The functional layers (3) typically comprise at least one outer covering layer (4) which serves as a printing layer and can be inked such that an image to be printed can be transferred from the surface of the covering layer (4) to printing material. It is advantageous to arrange a woven-fabric layer (5) below the covering lay, such as for example, a textile fabric or appropriately applied or attached threads of a textile material. A compressible layer (6), for example a layer of rubber or plastic material with enclosed air or gas bubbles, commonly is situated below the woven-fabric layer (5). In order to fasten the rubber-blanket plate to a cylinder, opposite longitudinal ends of the carrier plate (2) protrude outwardly of the functional layers and are bent over into a mounting channel of a rubber-covered cylinder (9) for securement by a clamping system (8), as depicted in FIG. 2.

Figure 2:
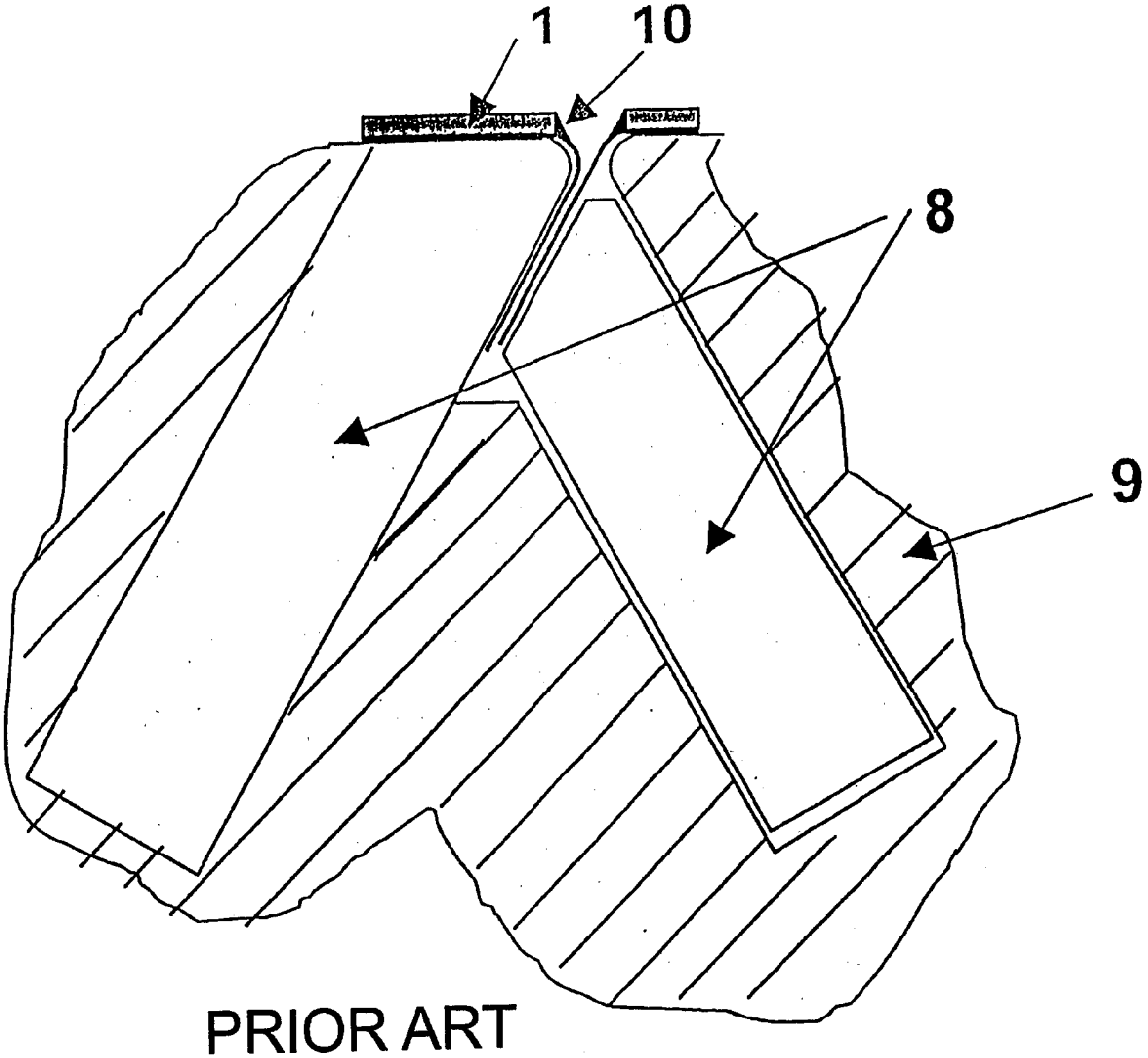
FIG. 2 is an enlarged fragmentary section showing the clamping of a known rubber-blanket plate, such as shown in FIG. 1, onto a blanket cylinder.

In such known rubber-blanket plate, as depicted in FIGS. 1 and 2, the edges 10 of the functional layers, and particularly the leading edge in relation to the direction of cylinder rotation, are initially subjected to attack by printing chemicals and mechanical loading, which can adversely effect the seal of the functional layers to the carrier plate (2) and result in possible damage or detachment of one or more of the layers. While the risk is reduced by providing a seal (11) at the edge, as shown in FIG. 1, problems still can occur due to stress and tension cracks in the seal (11).

In accordance with the invention, a rubber-blanket plate is provided which has increased surface life by avoiding the aforementioned problems of the prior art which lead to premature damage or destruction of the functional layers of the rubber-blanket plate. As will be seen, increased service life can be achieved both to the heavily loaded leading edge of the rubber-blanket plate, as well as the trailing edge when configured according to the invention.

Figure 3A:
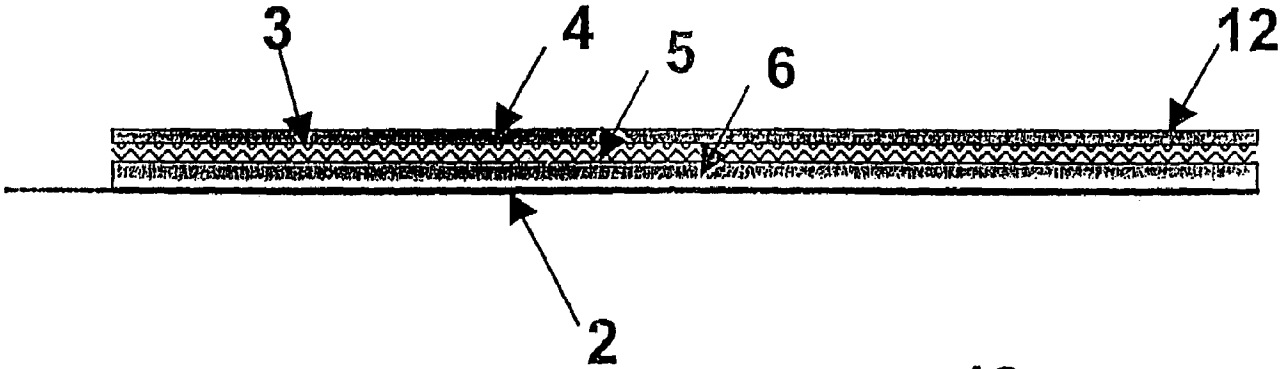
FIG. 3*a* is a longitudinal section of a rubber-blanket plate in accordance with the present invention.

With reference to FIG. 3*a*, there is shown an illustrative rubber-blanket (12) plate in accordance with the invention wherein items similar to those described above have been given similar reference numerals. The illustrated rubber-blanket plate (20) comprises a carrier plate (2) functional layers (3), and covering layer (12). Pursuant to an important aspect of the invention, the functional and covering layers extend completely to at least one end of the carrier plate (2), preferably the leading end of the carrier plate as viewed in the direction of rotation of a printing press cylinder upon which the rubber-blanket plate is mounted. In this case the lead edge of the rubber-blanket plate (12) is the right hand end of the plate shown in FIG. 3*a*. In the illustrated embodiment, the trailing end of the illustrated carrier plate (2), namely the left hand end as viewed in FIG. 3*a*, extends beyond the functional layer. Alternatively, it will be understood that the functional and cover layers (3) (4) could extend to both ends of the carrier plate (2), namely both the trailing and leading ends.

Figure 3B:
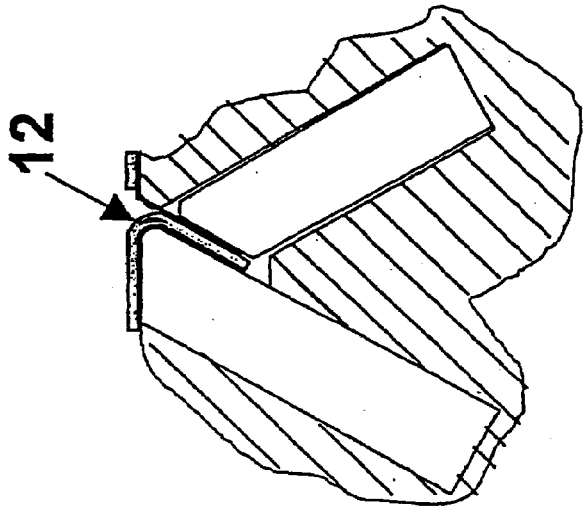
FIG. 3*b* is an enlarged fragmentary section showing the clamping of the rubber-blanket plate shown in FIG. 3 onto a blanket cylinder.

With reference to FIG. 3*b*, the rubber-blanket plate (12) is shown clamped to a rubber covered printing press cylinder. According to the invention, the right hand end of the rubber blanket plate (12), as viewed in FIG. 3*a*, is inserted into a channel of the blanket cylinder, whereas at the left hand end of the rubber-blanket plate, namely the trailing end, only the carrier plate is bent into the cylinder channel. With leading and trailing ends of the rubber-blanket plate (12) so positioned in the channel, they can be secured by the conventional clamping system as illustrated.

With the ends of the functional layers of the rubber-blanket plate (12) fixedly secured within the channel, as depicted in FIG. 3*b*, it can be seen that the ends of the functional layers are effectively retained and protected from impact and chemicals during a printing operation. Moreover, the width of the channel in the blanket cylinder can be made smaller than in known blanket cylinders having a conventional rubber-blanket covering.

Figure 4A:
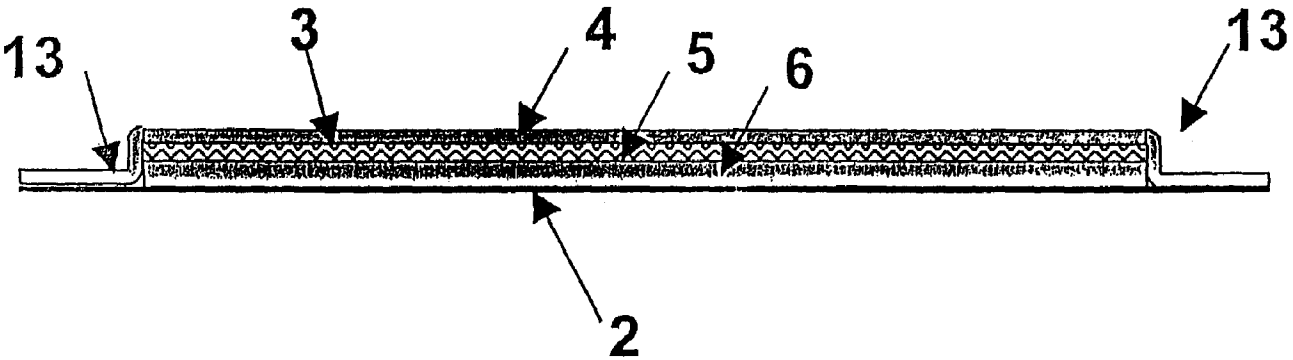
FIG. 4 is a fragmentary longitudinal section of an alternative embodiment of rubber-blanket plate according to the invention.
FIG. 4*b* is an enlarged fragmentary section of still another modified embodiment of a rubber-blanket plate according to the invention.
Figure 4B:
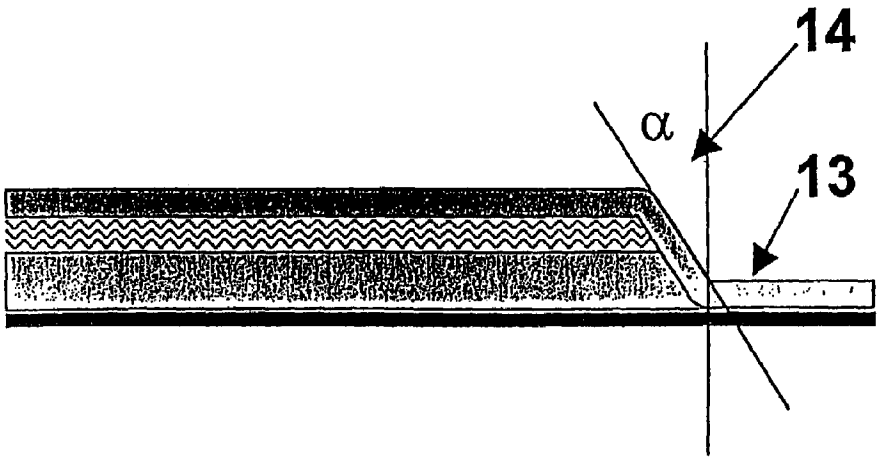

Referring now to FIGS. 4*a* and 4*b*, there is shown an alternative embodiment of a rubber-blanket plate (13) in accordance with the invention. The rubber-blanket plate (13) in this case again includes a carrier plate (2) and a functional layer which again includes a covering layer (4), a woven-fabric layer (5), and a compressible layer (6). In carrying out this aspect of the invention, the covering layer (4) extends to the ends of the carrier plate (12) in a manner that protectively contains the intermediate functional layers (5) and (6), which end at the bent over region of the carrier plate (2) short of the end of the corner plate (2). A similar arrangement can exist at both ends of the carrier plate (2).

It will be seen that the leading and trailing ends of the rubber-blanket plate (13) depicted in FIG. 4*a* can be clamped into the channel of a blanket cylinder with just the covering layer (4) and carrier plate (2) disposed within the channel. Hence, the edges of the functional layer are protected at both ends against physical and chemical abrasion with the result that service life of the plate is effectively increased. Moreover, the channel in the blanket cylinder can be made relatively narrow, and thereby reducing undesirable oscillations at the region of the clamping channel of the cylinder during printing. To further reduce oscillations, it is advantageous if the edges of the intermediate functional layers arranged beneath the cover layer (4) are cut at an angle (14) with respect to the carrier plate (2) which is not 90°, such as depicted in FIG. 4*b*. The resulting slanting surface further reduces impact and forces on the functional layers of the rubber-blanket late during high speed operation.

What is claimed is:

1. A rubber-blanket plate for clamping onto a cylinder (9) of a rotary offset printing press comprising to a carrier plate (2) which defines the length of the rubber blanket plate and is positionable about the cylinder (9) with leading and trailing ends of the carrier plate (2) being adapted for securement to the printing press cylinder, a plurality of functional layers (3) including an outer covering layer (13) and at least one intermediate functional layer between the covering layer (13) and the carrier plate (2), said carrier plate (2) extending beyond at least one end of said intermediate functional layer such that said at least one end of said intermediate functional layer does not extend to an end of said carrier plate (2), and said covering layer (13) extending beyond said at least one end of said intermediate functional layer into direct overlying fixed relation to said carrier plate (2).

2. The rubber-blanket plate of claim 1 including a plurality of intermediate functional layers, said intermediate functional layers including a woven fabric layer (5) and a compressible layer (6).

3. The rubber-blanket plate of claim 1 including a plurality of intermediate functional layers, said carrier plate having a bent over edge region for positioning into an axial channel of the printing press cylinder, and said intermediate functional layers end before the bent over region of the carrier plate.

4. The rubber-blanket plate of claim 3 in which said at least one end of the intermediate functional layer that does not extend to the end of the carrier plate is formed at an angle (14) with respect to the carrier plate (2) that is not 90°.

5. The rubber-blanket plate of claim 1 in which said carrier plate is a steel sheet having a thickness of about 0.200 mm.

6. The rubber-blanket plate of claim 1 in which said carrier plate is a sheet made of carbon fiber-reinforced plastic.

7. The rubber-blanket plate of claim 1 in which an end of said intermediate functional layer opposite said one end extends to an end of the carrier plate.

8. The rubber-blanket plate of claim 1 in which said covering layer extends beyond said at least one end of said intermediate functional layer to an end of said carrier plate.

9. The rubber-blanket plate of claim 1 in which opposite ends of said carrier plate extend outwardly beyond opposite ends of said intermediate functional layer, and said covering layer extends beyond said opposite ends of said intermediate functional layer into direct overlying, fixed relation to opposite extending ends of said carrier plate.

10. The rubber printing blanket of claim 4 in which said covering layer extends over said at least one end of said intermediate functional layer at an angle with respect to the carrier plate that is not 90°.

11. A printing press cylinder assembly comprising a rotatable cylinder, a rubber-blanket plate positioned about the cylinder, said cylinder having clamps for securing leading and trailing edges of the rubber-blanket plate as viewed in the direction of cylinder rotation, said rubber-blanket plate including a carrier plate (2) which defines the length of the rubber blanket plate and a plurality of functional layers (3) disposed on the carrier plate, said functional layers including an outer covering layer (13) and at least one intermediate functional layer between the covering layer (13) and the carrier plate (2), said carrier plate (2) extencling beyond at least one end of said intermediate functional layer such that said at least one end of said intermediate functional layer does not extend to an end of said carrier plate (2), and said covering layer (13) extending beyond said at least one end of said intermediate functional layer into direct overlying fixed relation to said carrier plate (2).

12. The printing press cylinder assembly of claim 11 in which all of the functional layers extend to one end of the carrier plate.

13. The printing press cylinder assembly of claim 11 in which said covering layer extends beyond said at least one end of said intermediate functional layer to an end of said carrier plate.

14. The printing press cylinder assembly of claim 11 in said opposite ends of said carrier plate extend outwardly beyond opposite ends of said intermediate functional layer, and said covering layer extends beyond said opposite ends of said intermediate functional layer into direct overlying, fixed relation to opposite extending ends of said carrier plate.

15. The printing press cylinder assembly of claim 11 including a plurality of intermediate functional layers, said carrier plate having a bent over edge region for positioning into an axial channel of the printing press cylinder, and said intermediate functional layers end before the bent over region of the carrier plate.

16. The printing press cylinder assembly of claim 11 in which said at least one end of the intermediate functional layer that does not extend to the end of the carrier plate is formed at an angle (14) with respect to the carrier plate (2) that is not 90°.

* * * * *